US007533605B1

(12) United States Patent
Morgan

(10) Patent No.: US 7,533,605 B1
(45) Date of Patent: May 19, 2009

(54) POT STABILIZING APPARATUS

(76) Inventor: Gregory L. Morgan, 2828 Evella St., Houston, TX (US) 77026

( * ) Notice: Subject to any disclaimer, the term of this patent is extended or adjusted under 35 U.S.C. 154(b) by 322 days.

(21) Appl. No.: 11/496,083

(22) Filed: Jul. 31, 2006

(51) Int. Cl.
*F24C 15/10* (2006.01)
*F24C 15/12* (2006.01)
*F24C 15/30* (2006.01)

(52) U.S. Cl. ..... 99/410; 126/24; 126/42; 99/403

(58) Field of Classification Search ..... None
See application file for complete search history.

(56) References Cited

U.S. PATENT DOCUMENTS 611,376 A 9/1898 Craig
1,622,587 A 3/1927 Housel
1,632,672 A 6/1927 Jeffels
3,198,189 A * 8/1965 Oatley ..... 126/24
3,515,116 A * 6/1970 Finnstrand ..... 126/24
3,960,134 A * 6/1976 Scott ..... 126/24
4,108,140 A * 8/1978 Wolze ..... 126/24
D251,050 S 2/1979 Wallsten
4,203,416 A * 5/1980 Simpson et al. ..... 126/212
4,296,728 A 10/1981 Hofstetter
4,337,752 A 7/1982 Leounes
4,638,786 A * 1/1987 Lucky ..... 126/24
4,745,905 A * 5/1988 Lucky ..... 126/24
4,934,333 A * 6/1990 Ducate et al. ..... 126/24
5,638,806 A * 6/1997 Foust ..... 126/24
5,669,372 A * 9/1997 Humphrey ..... 126/24
2007/0277802 A1 * 12/2007 Reed et al. ..... 126/42

* cited by examiner

*Primary Examiner*—Joseph M Pelham

(57) ABSTRACT

A pot stabilizing apparatus includes a tubular member that includes a lower loop and an upper loop. Each of the lower and upper loops has a substantially annular shape. The upper and lower loops have a substantially same size. A peripheral wall is attached to and extends between the upper and lower loops. A coupler is attached to the lower loop and is configured to releasably attach the lower loop to a surface heating unit. A pot is positioned in the tubular member when the lower loop is attached to the surface heating unit.

15 Claims, 3 Drawing Sheets

POT STABILIZING APPARATUS

BACKGROUND OF THE INVENTION

1. Field of the Invention

The present invention relates to cooking pan securing devices and more particularly pertains to a new cooking pan securing device for preventing the movement of a cooking pot or pan which is positioned on a surface heating unit.

2. Description of the Prior Art

The use of cooking pan securing devices is known in the prior art. While these devices fulfill their respective, particular objectives and requirements, the need remains for a device that secures a cooking pot or pan to a surface heating unit so that the cooking pot cannot be excessively moved and its contents spilled.

SUMMARY OF THE INVENTION

The present invention meets the needs presented above by generally comprises a tubular member that includes a lower loop and an upper loop. Each of the lower and upper loops has a substantially annular shape. The upper and lower loops have a substantially same size. A peripheral wall is attached to and extends between the upper and lower loops. A coupler is attached to the lower loop and is configured to releasably attach the lower loop to a surface heating unit. A pot is positioned in the tubular member when the lower loop is attached to the surface heating unit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
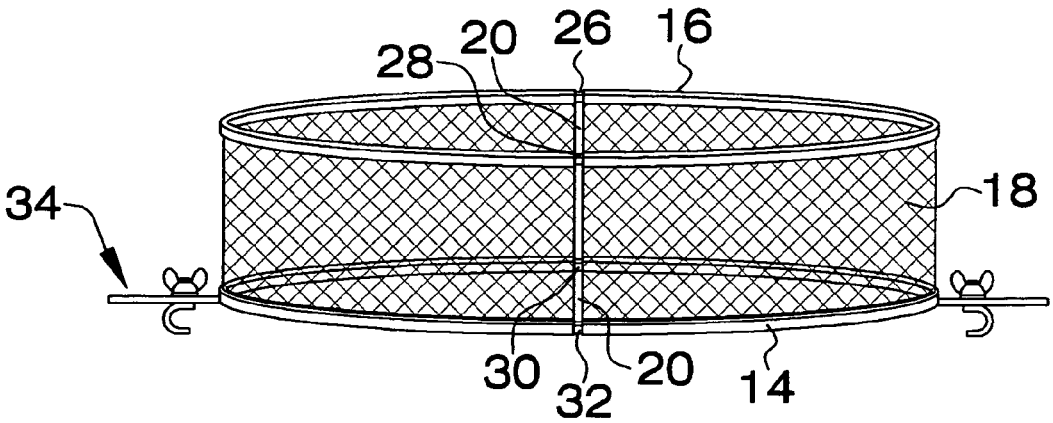
FIG. 1 is a side perspective view of a pot stabilizing apparatus according to the present invention.
Figure 2:
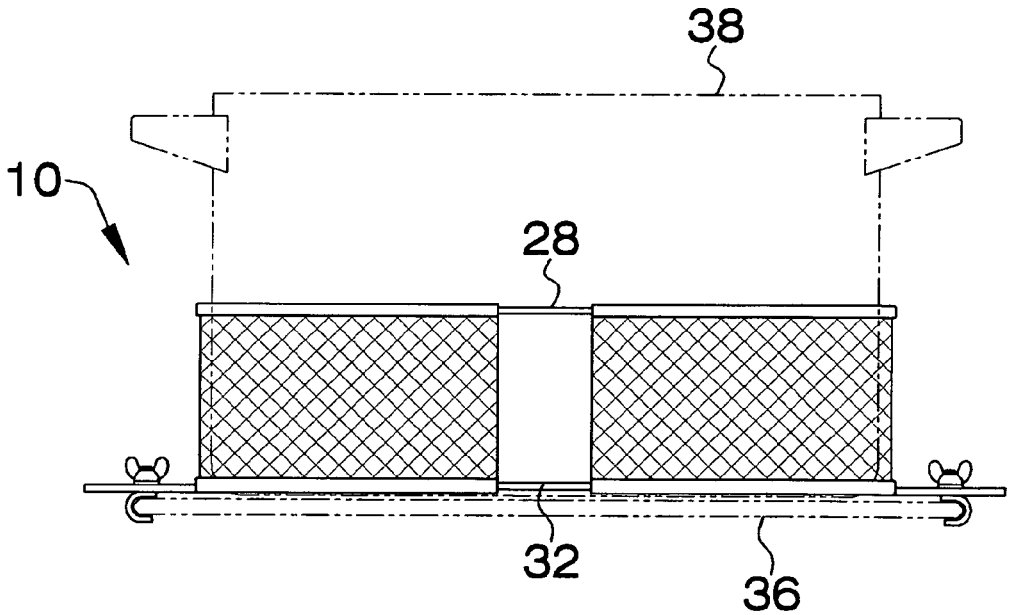
FIG. 2 is a side in-use view of the present invention.
Figure 3:
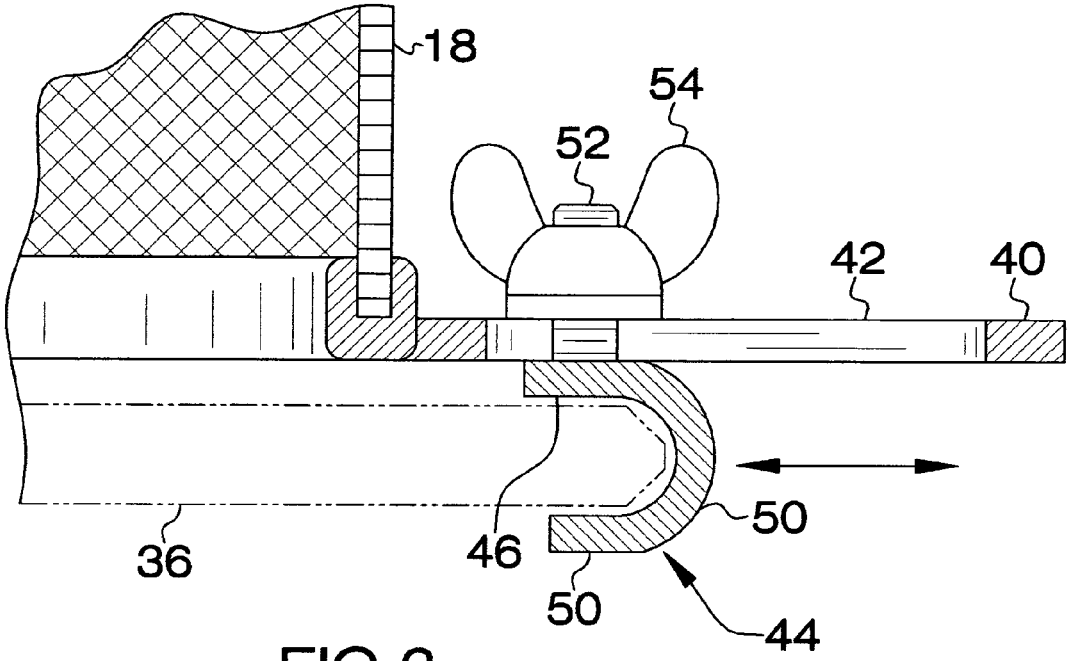
FIG. 3 is an enlarged, side cross sectional view of the present invention.
Figure 4:
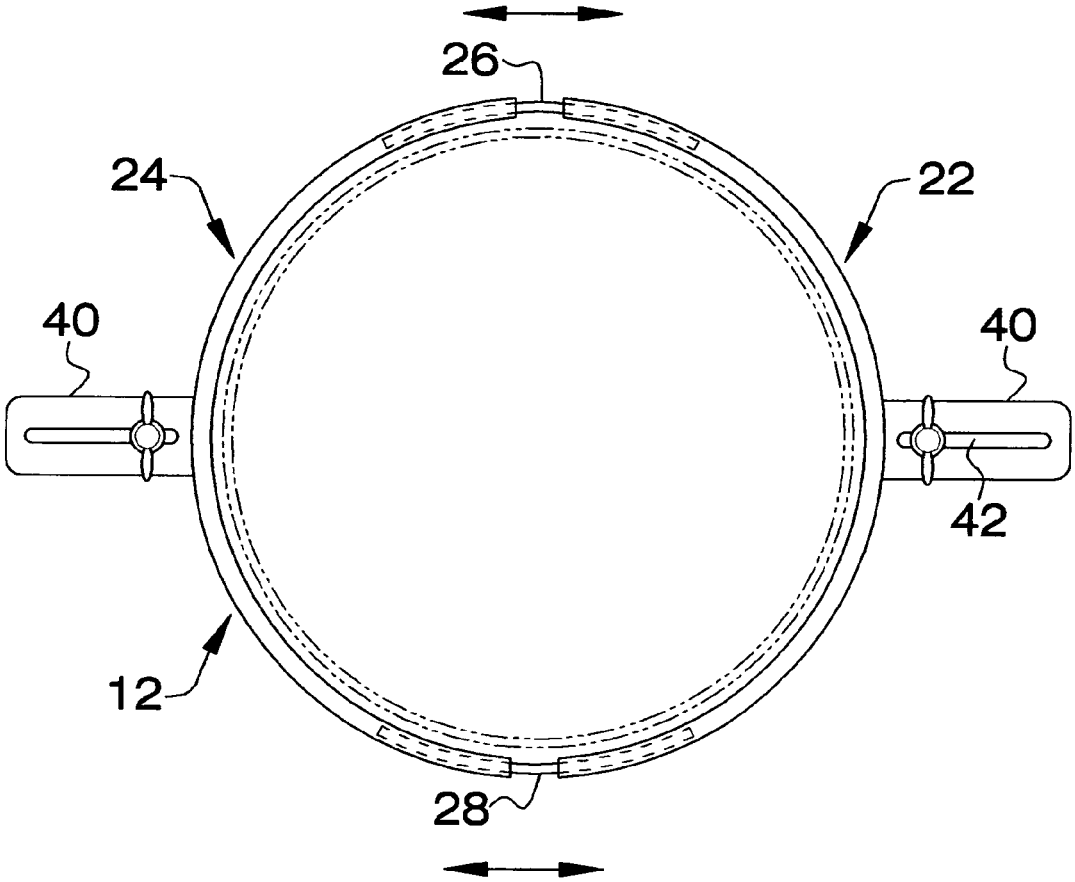
FIG. 4 is a top view of the present invention.

With reference now to the drawings, and in particular to FIGS. 1 through 4 thereof, a new cooking pan securing device embodying the principles and concepts of the present invention and generally designated by the reference numeral 10 will be described.

As best illustrated in FIGS. 1 through 4, the pot stabilizing apparatus 10 generally comprises a tubular member 12 that includes a lower loop 14 and an upper loop 16. Each of the lower 14 and upper 16 loops has a substantially annular shape.

The upper 16 and lower 14 loops each have a substantially same size. A peripheral wall 18 is attached to and extends between the upper 16 and lower 14 loops. The tubular member 12 has a pair of vertical breaks 20 therein and each extends through each of the lower 14 and upper 16 loops to define a first portion 22 and a second portion 24 of the tubular member 12. The first 22 and second 24 portions have a substantially same size as each other. The tubular member 12 has a height between about 1 inch and 6 inches and a diameter between 6 inches and 12 inches when the first 22 and second 24 portions are in abutment with each other. The peripheral wall 18 comprises a mesh material.

A first extender 26 and a second extender 28 each extend into one of the first 22 and second 24 portions of the upper loop 16 and are positioned opposite of each other. A third extender 30 and a fourth extender 32 each extend into one of the first 22 and second 24 portions of the lower loop 14 and are positioned opposite of each other. The first 26 and third 30 extenders are vertically aligned with each other and the second 28 and fourth 32 extenders are vertically aligned with each other.

A coupler 34 is attached to the lower loop 14 and is configured to releasably attach the lower loop 14 to a surface heating unit 36. A pot 38 is positioned in the tubular member 12 when the lower loop 14 is attached to the surface heating unit 36. The coupler 34 comprises a pair of plates 40. Each of the plates 40 is attached to and extends outwardly from the lower loop 14. The plates 40 extend in opposite directions with respect to each other and each lies in a plane defined by the lower loop 14. Each of the plates 40 has a longitudinal aperture 42 therein extending along a line bisecting an axis of the lower loop 14. A pair of hook members 44 is provided. Each of the hook members 44 is attached to and is selectively movable along a length of one of the plates 40. Each of the hook members 44 is substantially U-shaped and includes a first leg 46, a second leg 48 and a central section 50. Each of the first legs 46 has one of a pair of rods 52 attached thereto. The apertures 42 each have one of the rods 52 extending therethrough. The hook members 44 are each movable towards and engage the surface heating unit 36. Fasteners 54 are threadably coupled to each of the rods 52 and releasably secure each of the hook members 44 to a respective one of the plates 40.

In use, the tubular member 12 is attached to the surface heating unit 36. If need be, the tubular member 12 is extended in diameter using the extenders. The cooking pot 38 is then placed in the tubular member 12. The tubular member 12 prevents excessive movement of the cooking pot 38.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pot stabilizing assembly for stabilizing a pot positioned on a surface heating unit of a stove, said assembly including:

a tubular member including a lower loop and an upper loop, each of said lower and upper loops having a substantially annular shape, said upper and lower loops having a substantially same size, a peripheral wall being attached to and extending between said upper and lower loops;

a coupler being attached to said lower loop and being configured to releasably attach said lower loop to the surface heating unit, the pot being positioned in said tubular member when said lower loop is attached to the surface heating unit; and said tubular member having a pair of vertical breaks therein each extending through each of said lower and upper loops to define a first portion and a second portion of said tubular member, a plurality of extenders coupling together said first and second portions, said first and second portions being selectively positionable in a spaced relationship or in an abutted relationship with respect to each other.

2. The assembly according to claim 1, wherein said tubular member has a height between about 1 inch and 6 inches.

3. The assembly according to claim 1, wherein said tubular member has a diameter between 6 inches and 12 inches when said first and second portions are in abutment with each other.

4. The assembly according to claim 1, wherein said peripheral wall comprises a mesh material.

5. The assembly according to claim 1, wherein said plurality of extenders include:

a first extender and a second extender each extending into one of said first and second portions of said upper loop and being positioned opposite of each other; and a third extender and a fourth extender each extending into one of said first and second portions of said lower loop and being positioned opposite of each other, wherein said first and third extenders are vertically aligned with each other and said second and fourth extenders are vertically aligned with each other.

6. The assembly according to claim 1, wherein said coupler comprises:

a pair of plates;

a pair of hook members, each of said hook members being attached to and being selectively movable along a length of one of said plates, each of said hook members being movable towards and engaging the surface heating unit.

7. The assembly according to claim 1, wherein said coupler comprises:

a pair of plates, each of said plates being attached to and extending outwardly from said lower loop, said plates extending in opposite directions with respect to each other and each lying in a plane defined by said lower loop, each of said plates having a longitudinal aperture therein extending along a line bisecting an axis of said lower loop;

a pair of hook members, each of said hook members being attached to and being selectively movable along a length of one of said plates, each of said hook members being substantially U-shaped and including a first leg, a second leg and a central section, each of said first legs having one of a pair of rods attached thereto, each of said apertures having one of said rods extending therethrough, each of said hook members being movable towards and engaging the surface heating unit; and a pair of fasteners, each of said fasteners being threadably coupled to one of said rods and releasably securing each of said hook members to a respective one of said plates.

8. A pot stabilizing assembly for stabilizing a pot positioned on a surface heating unit of a stove, said assembly including:

a tubular member including a lower loop and an upper loop, each of said lower and upper loops having a substantially annular shape, said upper and lower loops having a substantially same size, a peripheral wall being attached to and extending between said upper and lower loops, said tubular member having a pair of vertical breaks therein each extending through each of said lower and upper loops to define a first portion and a second portion of said tubular member, said first and second portions having a substantially same size as each other, said tubular member having a height between about 1 inch and 6 inches, said tubular member having a diameter between 6 inches and 12 inches when said first and second portions are in abutment with each other, said peripheral wall comprising a mesh material;

a first extender and a second extender each extending into one of said first and second portions of said upper loop and being positioned opposite of each other;

a third extender and a fourth extender each extending into one of said first and second portions of said lower loop and being positioned opposite of each other, wherein said first and third extenders are vertically aligned with each other and said second and fourth extenders are vertically aligned with each other;

a coupler being attached to said lower loop and being configured to releasably attach said lower loop to the surface heating unit, the pot being positioned in said tubular member when said lower loop is attached to the surface heating unit, said coupler comprising:

a pair of plates, each of said plates being attached to and extending outwardly from said lower loop, said plates extending in opposite directions with respect to each other and each lying in a plane defined by said lower loop, each of said plates having a longitudinal aperture therein extending along a line bisecting an axis of said lower loop;

a pair of hook members, each of said hook members being attached to and being selectively movable along a length of one of said plates, each of said hook members being substantially U-shaped and including a first leg, a second leg and a central section, each of said first legs having one of a pair of rods attached thereto, each of said apertures having one of said rods extending therethrough, each of said hook members being movable towards and engaging the surface heating unit; and a pair of fasteners, each of said fasteners being threadably coupled to one of said rods and releasably securing each of said hook members to a respective one of said plates.

9. A pot stabilizing assembly for stabilizing a pot positioned on a surface heating unit of a stove, said assembly including:

a tubular member including a lower loop and an upper loop, each of said lower and upper loops having a substantially annular shape, said upper and lower loops having a substantially same size, a peripheral wall being attached to and extending between said upper and lower loops;

a coupler being attached to said lower loop and being configured to releasably attach said lower loop to the surface heating unit, the pot being positioned in said tubular member when said lower loop is attached to the surface heating unit, said coupler comprising:

a pair of plates; and a pair of hook members, each of said hook members being attached to and being selectively movable along a length of one of said plates, each of said hook members being movable towards and engaging the surface heating unit.

10. The assembly according to claim 9, wherein said tubular member has a height between about 1 inch and 6 inches.

11. The assembly according to claim 9, wherein said tubular member has a diameter between 6 inches and 12 inches when said first and second portions are in abutment with each other.

12. The assembly according to claim 9, wherein said peripheral wall comprises a mesh material.

13. The assembly according to claim 9, further including:

said tubular member having a pair of vertical breaks therein each extending through each of said lower and upper loops to define a first portion and a second portion of said tubular member;

a plurality of extenders coupling together said first and second portions, said first and second portions being selectively positionable in a spaced relationship or in an abutted relationship with respect to each other, said plurality of extenders including a first extender and a second extender each extending into one of said first and second portions of said upper loop and being positioned opposite of each other, said plurality of extenders further including a third extender and a fourth extender each extending into one of said first and second portions of said lower loop and being positioned opposite of each other, wherein said first and third extenders are vertically aligned with each other and said second and fourth extenders are vertically aligned with each other.

14. The assembly according to claim 13, wherein said coupler further comprises:

each of said plates being attached to and extending outwardly from said lower loop, said plates extending in opposite directions with respect to each other and each lying in a plane defined by said lower loop, each of said plates having a longitudinal aperture therein extending along a line bisecting an axis of said lower loop;

each of said hook members being substantially U-shaped and including a first leg, a second leg and a central section, each of said first legs having one of a pair of rods attached thereto, each of said apertures having one of said rods extending therethrough; and a pair of fasteners, each of said fasteners being threadably coupled to one of said rods and releasably securing each of said hook members to a respective one of said plates.

15. The assembly according to claim 9, wherein said coupler further comprises:

each of said plates being attached to and extending outwardly from said lower loop, said plates extending in opposite directions with respect to each other and each lying in a plane defined by said lower loop, each of said plates having a longitudinal aperture therein extending along a line bisecting an axis of said lower loop;

each of said hook members being substantially U-shaped and including a first leg, a second leg and a central section, each of said first legs having one of a pair of rods attached thereto, each of said apertures having one of said rods extending therethrough; and a pair of fasteners, each of said fasteners being threadably coupled to one of said rods and releasably securing each of said hook members to a respective one of said plates.

* * * * *